US010519907B2

(12) United States Patent
Fischer et al.

(10) Patent No.: US 10,519,907 B2
(45) Date of Patent: Dec. 31, 2019

(54) FUEL SYSTEM FOR A VEHICLE, A VEHICLE COMPRISING SUCH A FUEL SYSTEM AND A METHOD FOR SUPPLYING FUEL TO A COMBUSTION ENGINE

(71) Applicant: VOLVO CAR CORPORATION, Gothenburg (SE)

(72) Inventors: Kjell Fischer, Gothenburg (SE); Stella Johnsson, Kallered (SE); Joel Johansson, Gothenburg (SE); Christoffer Kallerman, Gothenburg (SE); Michael Zach, Hisings Backa (SE)

(73) Assignee: VOLVO CAR CORPORATION, Gothenburg (SE)

( * ) Notice: Subject to any disclaimer, the term of this patent is extended or adjusted under 35 U.S.C. 154(b) by 12 days.

(21) Appl. No.: 15/964,518

(22) Filed: Apr. 27, 2018

(65) Prior Publication Data

US 2018/0320648 A1 Nov. 8, 2018

(30) Foreign Application Priority Data

May 4, 2017 (EP) ..... 17169458

(51) Int. Cl.

| | |
|---|---|
| ***F02M 37/10*** | (2006.01) |
| ***F02M 37/18*** | (2006.01) |
| ***F02D 41/30*** | (2006.01) |
| *F02D 41/38* | (2006.01) |

(52) U.S. Cl.

CPC ..... *F02M 37/18* (2013.01); *F02D 41/3082* (2013.01); *F02D 41/3845* (2013.01); *F02D 2400/08* (2013.01); *F02M 37/10* (2013.01)

(58) Field of Classification Search

CPC .... F02M 37/18; F02M 37/10; F02D 41/3082; F02D 41/3845; F02D 2400/08

USPC ..... 123/446, 457, 495, 497, 510, 511; 701/103, 113; 73/114.52, 114.53

See application file for complete search history.

(56) References Cited

U.S. PATENT DOCUMENTS

| | | | | |
|---|---|---|---|---|
| 6,899,084 | B2 * | 5/2005 | Miyashita | F02D 33/003 123/446 |
| 8,302,582 | B2 * | 11/2012 | Oohashi | F02M 37/0029 123/446 |
| 8,485,790 | B2 | 7/2013 | Rumpf | |
| 9,500,135 | B2 * | 11/2016 | Bader | F02C 7/236 |
| 2007/0283935 | A1 * | 12/2007 | Yuda | F02D 41/065 123/497 |

(Continued)

FOREIGN PATENT DOCUMENTS

| | | |
|---|---|---|
| DE | 197 09 737 A1 | 9/1998 |
| DE | 10 2004 061 249 B3 | 8/2006 |

(Continued)

OTHER PUBLICATIONS

Extended European Search Report dated Oct. 11, 2017, Application No. 17169458.1-1603, Applicant Volvo Car Corporation, 8 Pages.

*Primary Examiner* — Hai H Huynh
(74) *Attorney, Agent, or Firm* — Brooks Kushman P.C.

(57) ABSTRACT

A fuel system for a vehicle, where the fuel system comprises a first fuel pump and a second fuel pump, and where the capacity of the first fuel pump is lower than the capacity of the second fuel pump. The advantage of the disclosure is that the supply of fuel to the combustion engine from the fuel system can be optimized with respect to energy usage.

20 Claims, 4 Drawing Sheets

(56) References Cited

U.S. PATENT DOCUMENTS

| | | | | |
|---|---|---|---|---|
| 2011/0011373 | A1* | 1/2011 | Shimura | F02D 41/3082 123/497 |
| 2011/0146627 | A1 | 6/2011 | Oohashi et al. | |

FOREIGN PATENT DOCUMENTS

| | | | |
|---|---|---|---|
| DE | 10 2005 008 380 | A1 | 8/2006 |
| EP | 1 857 661 | A2 | 11/2007 |
| JP | 2007-321583 | A | 12/2007 |
| JP | 2009-235960 | A | 10/2009 |

* cited by examiner

FUEL SYSTEM FOR A VEHICLE, A VEHICLE COMPRISING SUCH A FUEL SYSTEM AND A METHOD FOR SUPPLYING FUEL TO A COMBUSTION ENGINE

CROSS-REFERENCE TO RELATED APPLICATIONS

This application claims foreign priority benefits under 35 U.S.C. § 119(a)-(d) to European patent application number EP 17169458.1, filed May 4, 2017, which is incorporated by reference in its entirety.

TECHNICAL FIELD

The present disclosure relates to a fuel system for a vehicle comprising two fuel pumps and a vehicle comprising such a fuel system.

BACKGROUND

Vehicles comprising an internal combustion engine are subjected to a plurality of different legislative requirements and regulations. Some of these requirements and regulations are directed to fuel consumption and exhaust emission. Different countries or markets may have different requirements, but most include a specific test cycle that is supposed to give an indication of the fuel consumption and exhaust emission of the vehicle. However, there is normally a discrepancy between the fuel consumption and exhaust emission measured in a test cycle and the same measured in real world driving conditions.

Fuel consumption is one measure that is important when comparing different vehicles and it will further affect the exhaust emissions of the vehicle. A low fuel consumption is thus of advantage. Since modern vehicles are relatively optimized regarding fuel consumption, it is getting more and more difficult to reduce the fuel consumption further. At the same time, the driveability and safety of the vehicle may not be compromised.

One possibility to reduce fuel consumption is to optimize the components used in a vehicle. One such component is the fuel pump which is designed for a relatively high flow rate at a high engine speed, but which mostly is used at a relatively low flow rate, where the efficiency of the fuel pump is low.

DE 10 2004 061 249 suggests the use of two equal fuel pumps and a control unit. At low flow rates, the second fuel pump is disconnected and the control unit will control the rotational speed of the first fuel pump in dependency of the required flow rate. At higher flow rates, the first fuel pump will be connected directly to the battery such that it runs at full rotational speed, and the rotational speed of the second fuel pump will be controlled by the control unit in dependency of the required additional flow rate. The purpose of the described system is to simplify the control unit in order to reduce cost. The control unit must only be adapted to actively control half of the maximum flow rate, which reduces the size of the power semiconductors.

Even if this solution reduces the cost of the electronic control unit, it does not reduce the fuel consumption of the vehicle.

There is thus room for a fuel system that improves the fuel consumption of a vehicle.

SUMMARY

An object of the disclosure is therefore to provide an improved fuel system that comprises two fuel pumps, where the capacity of the fuel pumps differ. A further object of the disclosure is to provide a vehicle that comprises such a fuel system. A further object of the disclosure is to provide an improved method for supplying fuel to a combustion engine.

In a fuel system for a vehicle, where the fuel system comprises a first fuel pump and a second fuel pump, the object of the disclosure is achieved in that the capacity of the first fuel pump is lower than the capacity of the second fuel pump. By using two fuel pumps with different capacity, the capacity of the first fuel pump can be adapted to the most common driving conditions, and the capacity of the second fuel pump is adapted to the maximum fuel consumption at high engine speeds. The efficiency of the first fuel pump can thus be optimized for a low flow rate in the region of 10-20 liters per hour, whereas the efficiency of the second fuel pump peaks e.g., at 100-120 liters per hour. In most drive conditions of normal passenger cars, more than 80% and up to 95% is done with a flow rate below 15 liters per hour. For this reason, the efficiency of the first fuel pump can be optimized for such a low flow rate and energy can be saved.

The fuel system is suitable for both petrol and diesel systems, for systems with or without a return system, and for all kinds of fuel tanks. The first fuel pump and the second fuel pump are arranged in parallel, each having a non-return valve. Preferably, the capacity of the second fuel pump is at least two times higher and may be up to five times higher or more than the capacity of the first fuel pump. It is also possible to design the second fuel pump such that the combined capacity of the first fuel pump and the second fuel pump corresponds to the maximum fuel consumption. This will improve the energy saving further.

The second fuel pump is preferably controlled in dependency of the required fuel flow to the engine by an electronic control unit that controls the rotational speed of the fuel pump. The first fuel pump may either run at its nominal rotational speed or the rotational speed may also be controlled in dependency of the required fuel flow. The input to the electronic control unit may e.g., be a pressure sensor sensing the pressure in the fuel pipe to the high pressure pump, or may be an estimate on the used amount of fuel by the engine.

The fuel system is further provided with one or more jet pumps adapted to transfer fuel from one place to another. A jet pump can e.g., transfer fuel from the fuel tank to a smaller container in which the fuel pumps are arranged such that the supply of fuel to the fuel pumps will always be secured. A jet pump can also transfer fuel from one chamber to the other chamber in a saddle tank. A jet pump may e.g., be arranged only at the second fuel pump such that the second fuel pump is started when fuel needs to be transferred from one chamber to the other. In this way, the capacity of the first fuel pump can be reduced further.

When the engine is started, it is possible to engage both the first fuel pump and the second fuel pump for a short time period in order to build up a start pressure in the fuel system. In this case, the second fuel pump is only run for a short time.

In a method for supplying fuel to a combustion engine, where the fuel system comprises a first fuel pump and a second fuel pump, wherein the capacity of the first fuel pump is lower than the capacity of the second fuel pump, the steps of running the first fuel pump at low fuel consumption, running the second fuel pump at medium fuel consumption, and running the first and the second fuel pump at high fuel consumption, is comprised.

By this first embodiment of the method, the method will adapt the use of the fuel pumps to the actual fuel flow requirements. When the vehicle is driven at low fuel consumption, only the first fuel pump will be used to deliver fuel to the engine, when a higher fuel consumption is required, the second fuel pump or both the first and the second fuel pump is used to deliver fuel to the engine, depending on the actual fuel need. The first fuel pump is adapted to deliver fuel at low fuel consumption, which is the most common drive condition for a vehicle. The second fuel pump is adapted to deliver fuel at all other drive condition, and the output of the second fuel pump is preferably controlled in dependency of the required flow rate. The second fuel pump may be an existing fuel pump used in a conventional fuel system.

The second fuel pump may also be used to transfer fuel from the first chamber of a saddle tank to the second chamber. The second fuel pump can thus be engaged when the fuel level in the first chamber is below a predefined level. By engaging the transfer of fuel only when required, additional energy can be saved. In an ordinary system, the jet pump for transferring fuel is always active, which means that the fuel pump will always use more energy than needed.

In a vehicle, comprising an internal combustion engine, the object of the disclosure is achieved in that the vehicle comprises a fuel system, where the fuel system comprises a first fuel pump and a second fuel pump, wherein the capacity of the first fuel pump is lower than the capacity of the second fuel pump.

By this first embodiment of a vehicle according to the disclosure, the fuel system of the vehicle can be adapted to the actual fuel consumption requirements of the vehicle. By using a first fuel pump having a high efficiency at a low fuel consumption, energy can be saved.

BRIEF DESCRIPTION OF THE DRAWINGS

Embodiments of the disclosure will be described in greater detail in the following, with reference to the attached drawings, in which.

DETAILED DESCRIPTION

The embodiments of the disclosure with further developments described in the following are to be regarded only as examples and are in no way to limit the scope of the protection provided by the patent claims.

Figure 1:
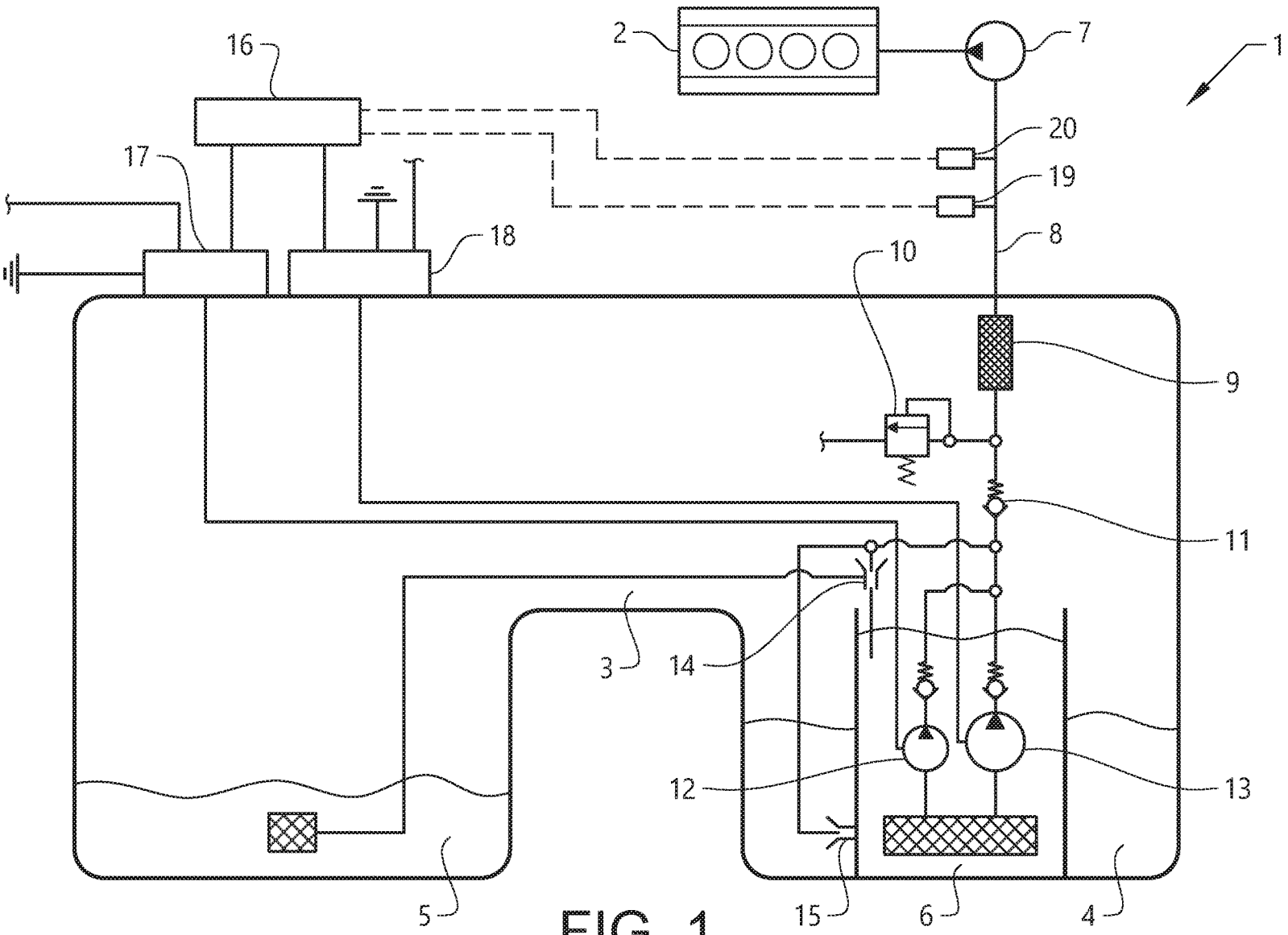
FIG. 1 shows a schematic fuel system according to the disclosure.

FIG. 1 shows a schematic fuel system according to the disclosure. The fuel system 1 is adapted to supply fuel to a combustion engine 2. The fuel system comprises a fuel tank 3, in the shown example a saddle tank comprising a first fuel chamber 4 and a second fuel chamber 5. The fuel tank is further provided with a smaller fuel container 6 which will secure the supply of fuel to the fuel pumps in case of low fill levels in the tank, when the vehicle is driven in a steep inclination or when the vehicle is accelerating. The shown fuel system supplies fuel to a high pressure pump 7 at the engine through a fuel pipe 8 comprising a fuel filter 9 and a pressure relief valve 10. In the shown example, a non-return valve 11 is provided at the outlet of the fuel system 1.

The fuel system comprises two fuel pumps, a first fuel pump 12 and a second fuel pump 13, where each fuel pump is provided with a non-return valve. The first fuel pump and the second fuel pump, or at least the inlet pipe of the fuel pumps, are arranged in the container 6 in order to secure that fuel can be delivered to the engine when the vehicle is cornering or travelling at inclined roads with a small amount of fuel in the tank. In the shown example, a first jet pump 14 is arranged to transfer fuel from the second fuel chamber to the first fuel chamber, here directly to the container, through a fuel pipe. A second jet pump 15 is arranged to transfer fuel from the first chamber 4 into the container 6.

The capacity of the first fuel pump is lower than the capacity of the second fuel pump. The capacity of the first fuel pump is adapted to drive conditions in which the flow rate is relatively low when compared to the maximum flow rate of the fuel system. Such drive conditions are the most common drive conditions and accounts for at least 80% and up to more than 95% of the driving of a normal passenger car. In a typical passenger car, the flow rate in this driving situation is below 15 liters per hour. The efficiency of the first fuel pump is thus preferably optimized for a low flow rate in the region of 10-20 liters per hour. The first fuel pump may either run at its nominal rotational speed or the rotational speed may also be controlled in dependency of the required fuel flow. The capacity of the first fuel pump is preferably less than 50 liters per hour, and may be less than 30 liters per hour.

The capacity of the second fuel pump is adapted to the maximum fuel consumption at high engine speeds, where the efficiency of the second fuel pump peaks e.g., at 100-120 liters or more per hour. The second fuel pump will be used when the fuel consumption is higher, e.g., when the vehicle is accelerating or driving at higher speeds. The second fuel pump may either be designed to be able to deliver the maximum flow rate alone, or it may be designed to be able to deliver the maximum flow rate together with the first fuel pump. The capacity of the second fuel pump is significantly higher than the capacity of the first fuel pump. Preferably, the capacity of the second fuel pump is at least twice as high as the capacity of the first fuel pump, and may be up to five times higher than the capacity of the first fuel pump. The capacity of the second fuel pump is preferably higher than 100 liters per hour, and may be up to 250 liters per hour, depending on e.g., the used combustion engine.

The fuel system further comprises an electronic control unit 16 which is adapted to control the first fuel pump and the second fuel pump in dependency of the required fuel flow to the engine. The electronic control unit is connected to a pressure sensor 19 which measures the pressure in the fuel pipe, and a temperature sensor 20 which measures the temperature of the fuel in the fuel pipe. These inputs are used to determine which fuel pump to use, and when to switch fuel pump. The electronic control unit is further connected to the electronic control system of the engine, e.g., through a data bus, where further control signals may be transmitted. One input to the electronic control unit may e.g., be an estimate on the fuel actually used by the engine.

Figure 2:
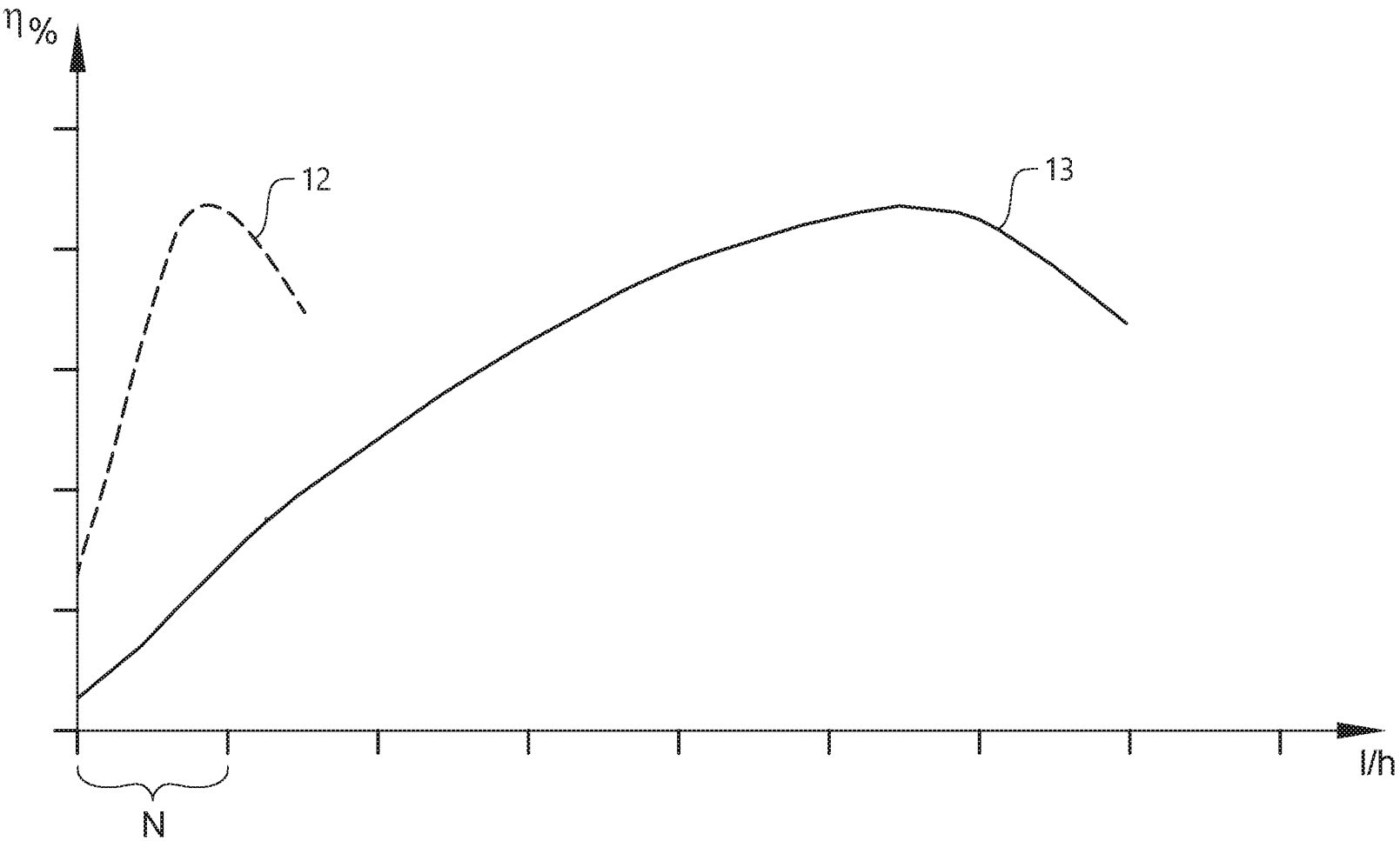
FIG. 2 shows a graph for the efficiency vs. flow of the first fuel pump and the second fuel pump according to the disclosure.

The electronic control unit 16 controls a first pump control unit 17 and a second pump control unit 18. The first pump control unit 17 may be either an on-off switch which engages and disengages the first pump, or it may control the rotational speed of the first fuel pump in dependency of the required flow rate. Since the flow range of the first fuel pump is relatively small, a switch is a cost-effective solution. The second pump control unit 18 preferably controls the rotational speed of the second fuel pump in dependency of the required flow rate. The flow range of the second fuel pump is relatively large. FIG. 2 shows a graph for the flow rates of the first fuel pump 12 and the second fuel pump 13, with efficiency on the y-axis and flow on the x-axis. The range for the most common drive conditions is indicated as N.

The fuel system is suitable for fuel systems in which the required flow rate varies over a large range, and in which a low flow rate is used most of the time. The fuel is a liquid fuel and may be petrol, diesel, ethanol, methanol or different kinds of biofuels with or without additives. The fuel system is also suitable for systems with or without a return system, and for all kinds of fuel tanks.

In the shown fuel system, a saddle tank is used as an example. In order to be able to transfer fuel from the second chamber of the fuel tank to the first chamber, a jet pump is used. The jet pump is driven by a part of the flow from a fuel pump. In the shown example, the first jet pump arranged to transfer fuel from the second chamber to the first chamber is driven by the fuel pump that is active, which may be either the first fuel pump, the second fuel pump or both the first and the second fuel pump. It would also be possible to drive the first jet pump only by the second fuel pump. This would relieve the first fuel pump somewhat. When the fuel level sensor detects that fuel should be transferred from the second chamber to the first chamber, the second fuel pump is engaged such that the flow from the second fuel pump drives the first jet pump.

As one skilled in the art would understand, the electronic control unit 16, the first pump control unit 17, the second pump control unit 18, the electronic control system of the engine, and any other system, subsystem, device or module described herein may individually, collectively, or in any combination comprise appropriate control circuitry, such as one or more appropriately programmed processors (e.g., one or more microprocessors including central processing units (CPU)) and associated memory, which may include stored operating system software and/or application software executable by the processor(s) for controlling operation thereof and for performing the particular algorithms represented by the various functions and/or operations described herein, including interaction between and/or cooperation with each other. One or more of such processors, as well as other circuitry and/or hardware, may be included in a single ASIC (Application-Specific Integrated Circuitry), or several processors and various circuitry and/or hardware may be distributed among several separate components, whether individually packaged or assembled into a SoC (System-on-a-Chip).

Figure 3:
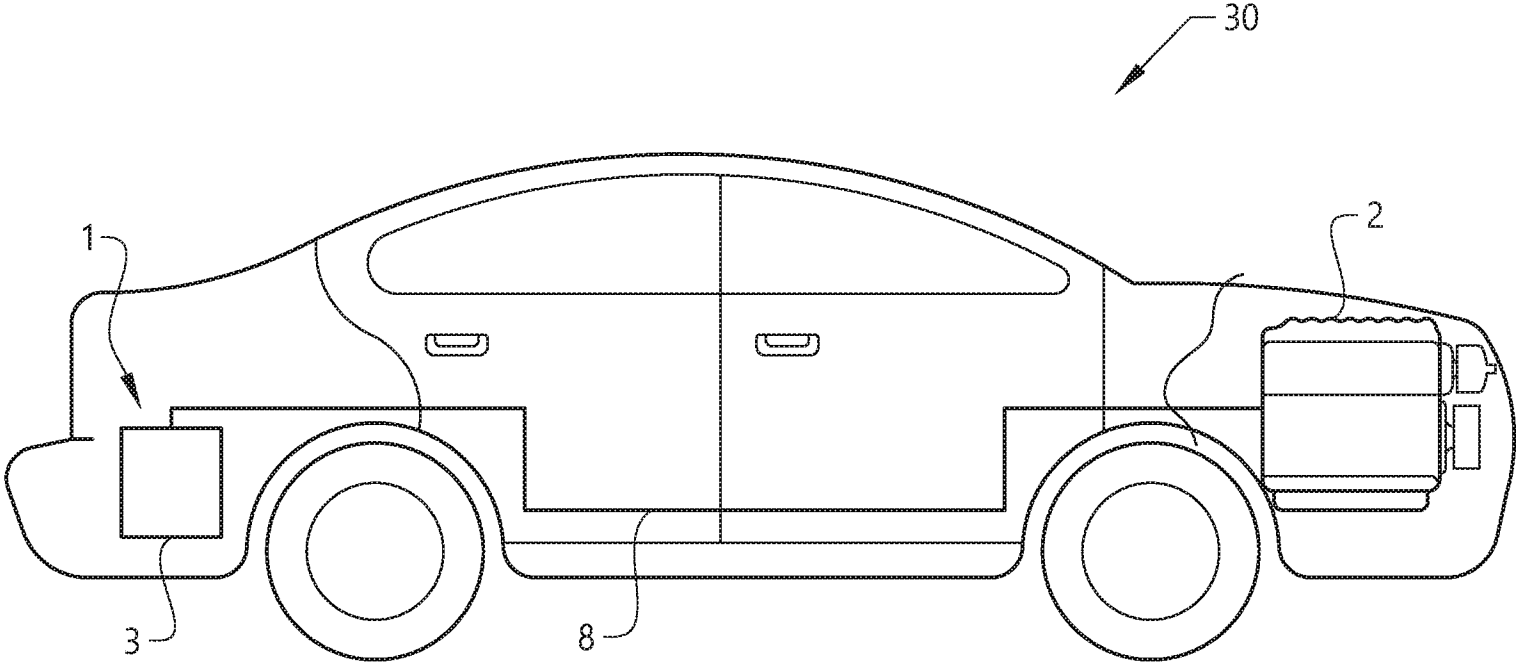
FIG. 3 shows a schematic vehicle according to the disclosure.

FIG. 3 shows a vehicle 30 provided with a fuel system according to the disclosure. In the shown example, the fuel tank is positioned at the rear of the vehicle with the combustion engine at the front. Other positions for the fuel tank and/or the engine are also plausible.

Figure 4:
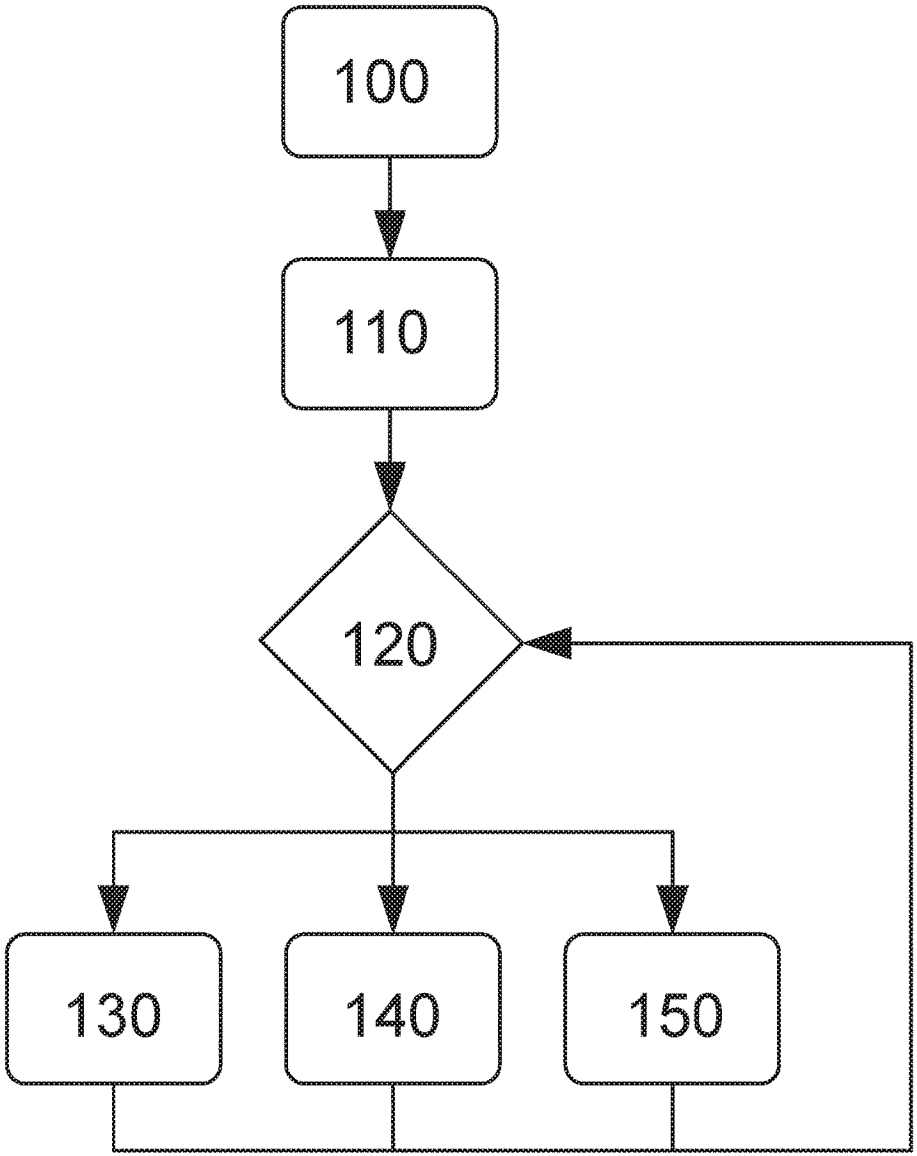
FIG. 4 shows a schematic flow chart of an inventive method for supplying fuel to a combustion engine in a vehicle.

FIG. 4 shows a schematic flow chart of the method for supplying fuel to a combustion engine. The method is performed when the combustion engine of the vehicle is running. The method steps are preferably performed by a computer program and a computer program product contained and run in the electronic control unit of the vehicle.

In step 100, the combustion engine of the vehicle is started. To start the combustion engine, the ignition is turned on. The first fuel pump is then engaged in order to deliver fuel to the high pressure pump of the engine. The first fuel pump preferably runs with a predefined rotational speed during the start of the engine. It is also possible to start the second fuel pump for a short time period in order to build up a fuel pressure faster.

In step 110, the combustion engine is started and runs with idle speed. The fuel consumption is now low such that the first fuel pump can deliver the required fuel flow to the engine.

In step 120, the vehicle drives forwards, and the electronic control unit determines the drive condition and the required amount of fuel. Depending on the drive condition, one of the following steps is selected.

In step 130, the vehicle drives at a moderate speed with low fuel consumption, i.e., the accelerator pedal is pressed lightly. In this case, the first fuel pump can deliver the required fuel flow to the engine in order to preserve the speed of the vehicle.

In step 140, the vehicle drives at a high speed with medium fuel consumption or accelerates moderately. In this case, the second fuel pump is engaged and driven at a medium rotational speed, and the first fuel pump is disengaged. Depending on the drive condition, the rotational speed of the second fuel pump is controlled in order to deliver the required fuel to the high pressure pump of the engine.

In step 150, the vehicle accelerates at a high rate with maximum fuel consumption or drives with a very high speed. In this case, the second fuel pump is engaged and driven at full rotational speed. Depending on the design of the second fuel pump, the first fuel pump may also be engaged. In any case, the fuel system delivers fuel at the maximum flow rate.

The electronic control unit continues to determine the actual drive condition and determines which fuel pump to engage, and the rotational speed for that fuel pump.

The disclosure is not to be regarded as being limited to the embodiments described above, a number of additional variants and modifications being possible within the scope of the subsequent patent claims.

What is claimed is:

1. A fuel system for a vehicle, the fuel system comprising: a first fuel pump, a second fuel pump, a fuel tank and a first jet pump configured to transfer fuel from a second chamber of the fuel tank to a first chamber of the fuel tank, wherein a capacity of the first fuel pump is lower than a capacity of the second fuel pump, the second fuel pump is configured to be operated to transfer fuel from the second chamber to the first chamber in dependency of a signal from a fuel level sensor, and flow from the second fuel pump is usable to drive the first jet pump.

2. The fuel system according to claim 1, wherein the capacity of the second fuel pump is at least twice as large as the capacity of the first fuel pump.

3. The fuel system according to claim 1, wherein the capacity of the second fuel pump is at least four times as large as the capacity of the first fuel pump.

4. The fuel system according to claim 3, wherein the capacity of the second fuel pump is greater than 100 liters per hour.

5. The fuel system according to claim 3, wherein the capacity of the first fuel pump is less than 50 liters per hour.

6. The fuel system according to claim 1, wherein the capacity of the second fuel pump is configured to supply fuel at maximum fuel consumption of the vehicle.

7. The fuel system according to claim 1, wherein the capacity of the second fuel pump is greater than 100 liters per hour.

8. The fuel system according to claim 1, wherein the capacity of the first fuel pump is less than 50 liters per hour.

9. The fuel system according to claim 1, wherein the capacity of the first fuel pump is less than 30 liters per hour.

10. The fuel system according to claim 1, wherein the first fuel pump is configured to run at nominal speed and rotational speed of the second fuel pump is controllable in dependency of required fuel flow to an engine of the vehicle.

11. A vehicle comprising an internal combustion engine and the fuel system according to claim 1.

12. A method for supplying fuel to a combustion engine from a fuel system that includes a first fuel pump and a second fuel pump, wherein a capacity of the first fuel pump is lower than a capacity of the second fuel pump, the method comprising:

starting the combustion engine;

at a low fuel consumption, running the first fuel pump;

at a medium fuel consumption higher than the low fuel consumption, running the second fuel pump with a controlled rotational speed; and at a high fuel consumption higher than the medium fuel consumption, running the second fuel pump at full rotational speed.

13. The method according to claim 12, wherein the first fuel pump is also operated at the high fuel consumption.

14. The method according to claim 12, wherein, at the low fuel consumption, the second fuel pump is started based on a signal from a fuel level sensor.

15. A computer program comprising program code for performing the method of claim 12 when the program is run on a computer.

16. The method according to claim 12, wherein, at the low fuel consumption, the second fuel pump is started at a signal from a fuel level sensor in order to transfer fuel from a second chamber to a first chamber with a first jet pump, and wherein the flow from the second fuel pump drives the first jet pump.

17. The method according to claim 16, wherein the fuel system comprises a fuel tank including the first and second chambers.

18. The method according to claim 17, wherein the first fuel pump is also operated at the high fuel consumption.

19. A non-transitory computer readable medium having stored computer executable instructions which, when executed in a fuel system for supplying fuel to a combustion engine, the fuel system including a first fuel pump and a second fuel pump, wherein a capacity of the first fuel pump is lower than a capacity of the second fuel pump, cause the fuel system to:

at a first fuel consumption, run the first fuel pump;

at a second fuel consumption higher than the first fuel consumption, run the second fuel pump with a rotational speed less than full rotational speed; and at a third fuel consumption higher than the second fuel consumption, run the second fuel pump at full rotational speed.

20. The non-transitory computer readable medium according to claim 19, wherein the stored computer executable instructions are executable to cause, at the first fuel consumption, the fuel system to start the second fuel pump based on a signal from a fuel level sensor in order to transfer fuel from a second chamber to a first chamber with a first jet pump that is drivable by flow from the second fuel pump.

* * * * *